United States Patent [19]

Yamamoto et al.

[11] 3,984,955

[45] Oct. 12, 1976

[54] EXTERIOR WINDOW UNIT HAVING IMPROVED FRAME SILL

[75] Inventors: Yukio Yamamoto; Mitsuo Nagase, both of Kurobe, Japan

[73] Assignee: Yoshida Kogyo Kabushiki Kaisha, Tokyo, Japan

[22] Filed: Dec. 24, 1975

[21] Appl. No.: 644,154

[30] Foreign Application Priority Data

Dec. 26, 1974 Japan ..... 50-3882[U]

[52] U.S. Cl. ..... 52/202; 49/63; 49/404; 52/211; 52/213; 160/90

[51] Int. Cl.[2] ..... E06B 3/26

[58] Field of Search ..... 52/202, 204, 206, 209, 52/210, 211, 212, 213, 214; 49/404, 409–411, 61, 63, 504; 160/90, 91

[56] References Cited

UNITED STATES PATENTS

| | | | |
|---|---|---|---|
| 1,866,882 | 7/1932 | Dixson | 49/63 X |
| 2,663,917 | 12/1953 | Peterson | 160/90 |
| 2,764,235 | 9/1956 | Renton | 160/91 |
| 2,960,734 | 11/1960 | Collins | 52/202 X |
| 3,226,779 | 1/1966 | Rust | 49/63 X |
| 3,295,277 | 1/1967 | Potter et al. | 52/211 |
| 3,694,961 | 10/1972 | Johnson | 49/504 |

*Primary Examiner*—Alfred C. Perham
*Attorney, Agent, or Firm*—Hill, Gross, Simpson, Van Santen, Steadman, Chiara & Simpson

[57] ABSTRACT

An exterior window unit for covering an opening in a building wall includes a frame sill which is slidable coupled with an elongated attachment plate member to be secured to a top surface of the fixed sill of a normally present window assembly in the building wall. To effect such coupling, the frame sill has a mounting fin having engaging means with a groove formed longitudinally therethrough. The attachment plate member has an engaging member which is complementary in cross-section to and received in the groove in the engaging means. The attachment plate member is thus positionable longitudinally relative to the mounting fin so as to be able to be interposed snugly between the side jambs of the normally present window assembly.

3 Claims, 4 Drawing Figures

EXTERIOR WINDOW UNIT HAVING IMPROVED FRAME SILL

BACKGROUND OF THE INVENTION

1. Field of the Invention

This invention relates to a window unit having an improved frame sill which is mounted on the outside of an opening in a building wall.

2. Prior Art

Exterior window units have been widely used because they provide a high degree of thermal insulation, air-tightness, and sound insulation and yet they retain the pleasing appearance of window assemblies which are composed mainly of paper screen sashes and normally present in openings enclosed by building walls. The frame sills of the exterior window units have vertical mounting fins to be mated with and secured to exterior surfaces of the sills of the normally present window assemblies, the mounting fins having horizontal engaging flanges formed integrally therewith and projecting inwardly from fin top ends. The horizontal engaging flanges are secured to top surfaces of the sills of the pre-installed window assemblies. However, the integrally formed engaging flanges present difficulty since the exterior window units cannot be mounted snugly in position, especially where the side jambs of the pre-installed window assemblies are inclined relative to their vertical axis or otherwise deformed, as shown by the side jambs of FIG. 4 hereof.

SUMMARY OF THE INVENTION

It is therefore a primary object of the invention to provide an improved frame sill for use in exterior window units, which sill will allow the units to be installed in position on fixed frames of the kind having inclined side jambs in normally present window assemblies in building walls.

It is another object of the invention to provide an improved frame sill for use in exterior window units, which sill can be mounted on the fixed sills of pre-installed window assemblies with maximum tightness.

According to the invention, a frame sill is coupled with an elongated attachment plate member to be secured to a top surface of a fixed sill. The frame sill has a mounting fin securable to the fixed sill and having at its top portion elongated engaging means having a groove extending longitudinally therethrough. The attachment plate member has at its outer end an engaging member which is complementary in cross-section to and inserted in the groove in the engaging means from a longitudinal end of the latter. The attachment plate member is longitudinally adjustable relative to the mounting fin so as to be interposed snugly between the side jambs of the pre-installed window assembly.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
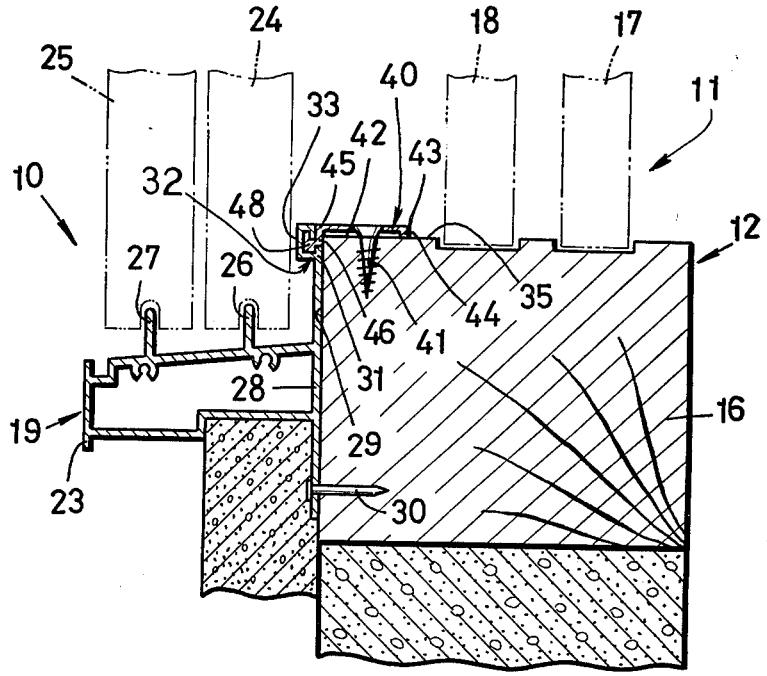
FIG. 1 is a fragmentary vertical cross-sectional view showing the frame sill of an exterior window unit mounted on the fixed sill of a pre-installed window assembly.
Figure 4:
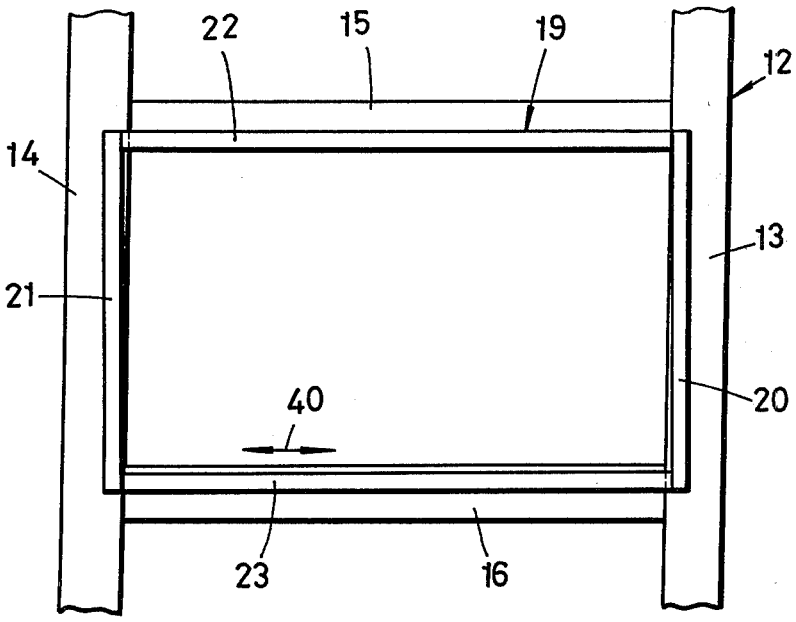
FIG. 4 is a schematic elevational view of the exterior window unit secured to the fixed frame having inclined side jambs.

FIG. 1 shows an exterior window unit 10 mounted on the exterior of a building wall and covering an opening 11 therein. A fixed frame 12 comprises a pair of side jambs 13, 14, a header 15, and a sill 16 (FIG. 4). A pair of spaced, inner sashes 17, 18 are normally mounted in the fixed frame 12 for horizontal, sliding movement therein.

The exterior window unit 10 broadly comprises a frame 19 which is preferably an aluminum extrusion and includes a pair of side jambs 20, 21, a header 22, and a sill 23 (FIG. 4). A pair of relatively movable sashes 24, 25 of the rolling or sliding type are mounted within the frame 19 in parallel, closely spaced planes and ride on a pair of upwardly projecting flanges or rails 26, 27, respectively. The frame sill 23 has a vertical mounting fin 28 formed integrally therewith and fixed to an exterior vertical surface 29 of the sill 16 by a number of nails 30 which pass through a lower part of the mounting fin 28 into the sill 16.

Figure 2:
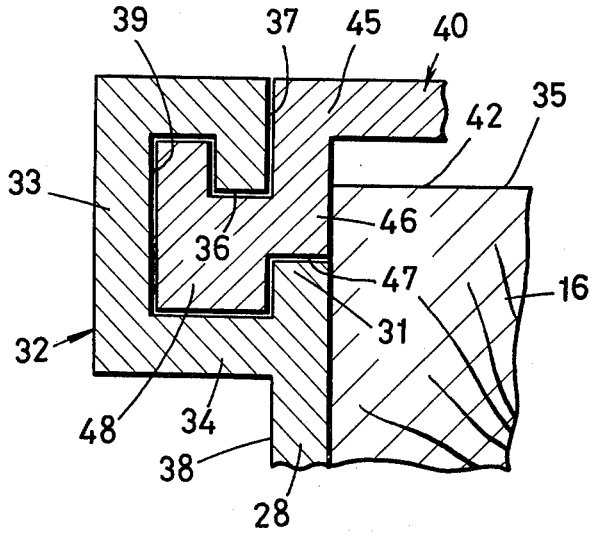
FIG. 2 is an enlarged view of a portion of FIG. 1.
Figure 3:
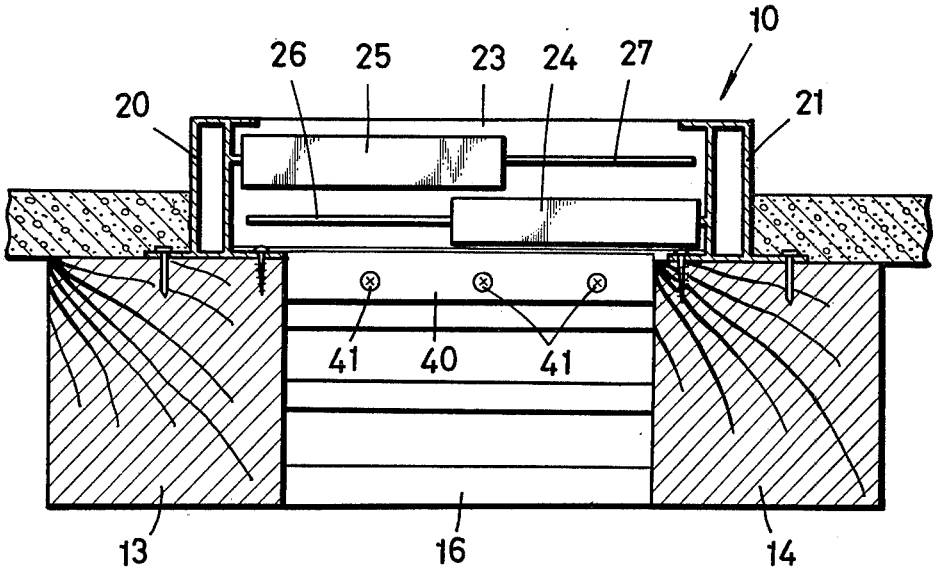
FIG. 3 is a horizontal cross-sectional view of the exterior window unit secured to the fixed frame of the pre-installed window assembly.

The mounting fin 28 has adjacent to its top end or edge 31 engaging means 32 extending longitudinally therealong and comprising a substantially cross-sectionally C-shaped flange 33 which is formed integrally with and projects outwardly from the fin 28, as best shown in FIG. 2. The flange 33 has a bottom portion 34 displaced slightly downwardly from the top end or edge 31. The flange 33 extends upwardly beyond a top surface 35 of the sill 16 and has near its free end 36 an inwardly facing vertical surface 37 lying substantially flush with an outer surface 38 of the mounting fin 28. The cross-sectionally C-shaped flange 33 thus constructed has a groove 39 formed longitudinally therethrough. An elongated attachment plate member 40 is secured to the top surface 35 by a number of wood screws 41 and extends along an outer marginal edge 42 of the top surface 35. The attachment plate member 40 is slightly shorter in length than the frame sill 23. The attachment plate member 40 has a flange 44 projecting downwardly from its inner edge 43 and has a flange 46 projecting downwardly from its outer edge 45, the flange 46 having a bottom face 47 held in contact with the top end or edge 31. An elongated engaging member 48 is formed integrally with the flange 46 and projects outwardly from the bottom edge 47. The elongated engaging member 48 is complementary in cross-section to the groove 39 in the C-shaped flange 33. The plate member 40 is spaced upwardly of the top surface 35 by the flanges 44, 46.

For installation of the exterior window unit 10, the attachment plate member 40 is first slidably coupled with the mounting fin 28 with the elongated engaging member 48 inserted in the groove 39 in the C-shaped flange 33 from a longitudinal end of the flange 33. Then, the side jambs 20, 21 and the header 22 and the sill 23 are bolted together to assemble the entire frame 19. The attachment plate member 40 is slidable along the flange 33 but is firmly interengaged with the mounting fin 28. The plate member 40 is longitudinally positioned in the direction of the arrow 40 of FIG. 4 in order to be received between the inclined jambs 13, 14, after which the frame 19 is secured to the fixed frame 12 by the nails 30. The plate member 40 is affixed to the fixed sill 16 by the wood screws 41.

With this arrangement, the exterior window unit 10 can be mounted in position on the fixed frame 12 having the inclined side jambs 13, 14 since the attachment plate member 48 is longitudinally adjustable relative to the mounting fin 28 so as to be interposed snugly between the inclined side jambs 13, 14. Furthermore, the frame sill 28 can be secured to the fixed sill 16 with maximum firmness because the flange 33 interfits positively with the plate member 40 screwed to the top surface 35 of the sill 16.

The engaging means 32 and the engaging member 48 may have other cross-sectional shapes provided that they are slidable longitudinally relative to each other when in interengaged relation.

Although various minor modifications may be suggested by those versed in the art, it should be understood that we wish to embody within the scope of the patent warranted hereon, all such embodiments as reasonably and properly come within the scope of our contribution to the art.

What is claimed is:

1. An exterior window unit for covering an opening in a building wall, the opening having a first sill from the ends of which a pair of side jambs extend vertically, said exterior window unit comprising:

a. a frame having a second sill;

b. a pair of sashes mounted within said frame in parallel, closely spaced planes;

c. mounting means on said second sill and adapted to be attached to the vertical exterior surface of said first sill, said mounting means having first engaging means with a groove formed longitudinally therethrough; and d. a plate member for extending along an outer marginal edge of and adapted to be secured to a top surface of the first sill between the side jambs, said plate member having at its outer edge a second engaging means which is complementary in cross-section to and received in said groove, and being adjustable longitudinally relative to said mounting means.

2. An exterior window unit according to claim 1, in which said first engaging means is a cross-sectionally C-shaped flange.

3. An exterior window unit according to claim 1, in which said plate member is shorter in length than said second sill.

* * * * *